US005711238A

United States Patent [19]

Matsuo et al.

[11] Patent Number: 5,711,238

[45] Date of Patent: Jan. 27, 1998

[54] OVERLOCK SEWING MACHINE

[75] Inventors: Osamu Matsuo; Yoshikazu Suzuki, both of Osaka, Japan

[73] Assignee: Jaguar Co., Ltd., Osaka, Japan

[21] Appl. No.: 610,915

[22] Filed: Mar. 5, 1996

[30] Foreign Application Priority Data

Mar. 30, 1995 [JP] Japan ..... 7-074140

[51] Int. Cl.[6] ..... D05B 1/20; D05B 47/02

[52] U.S. Cl. ..... 112/255; 112/162; 112/168

[58] Field of Search ..... 112/162, 168, 112/475.26, 254, 255

[56] References Cited

U.S. PATENT DOCUMENTS

| | | | |
|---|---|---|---|
| 2,157,373 | 5/1939 | Weis . | |
| 4,721,049 | 1/1988 | Hanyu et al. | 112/168 |
| 4,726,308 | 2/1988 | Aida et al. . | |
| 4,803,936 | 2/1989 | Mikuni et al. . | |
| 5,216,970 | 6/1993 | Sakuma | 112/168 |
| 5,237,942 | 8/1993 | Satoma | 112/168 X |
| 5,529,003 | 6/1996 | Kojima et al. | 112/168 |

FOREIGN PATENT DOCUMENTS

| | | |
|---|---|---|
| 3529369 | 11/1986 | Germany . |
| 7-96093 | 4/1995 | Japan . |

*Primary Examiner*—Paul C. Lewis

*Attorney, Agent, or Firm*—Lowe, Price, LeBlanc & Becker

[57] ABSTRACT

An overlock sewing machine which can switch its operation from an ordinary over-edge chain stitch to a rolled seam or vice versa with no requirement for a complicated operation of adjusting thread tension is obtained. This overlock sewing machine is provided with a spring for providing a thread with prescribed tension. The overlock sewing machine is further provided with a switching mechanism for switching the thread tension between that for the rolled seam and that for the over-edge chain stitch by switching the spring between a tensioning state and a non-tensioning state. Thus, the thread tension is readily switched between that for the rolled seam and that for the over-edge chain stitch.

6 Claims, 6 Drawing Sheets

OVERLOCK SEWING MACHINE

BACKGROUND OF THE INVENTION

1. Field of the Invention

The present invention relates to an overlock sewing machine, and more specifically, it relates to an overlock sewing machine which can readily switch its operation between an ordinary over-edge chain stitch and a rolled seam.

2. Description of the Background Art

In general, a rolled seam is formed by employing an overlock sewing machine with one needle and three threads or an overlock sewing machine with one needle and two threads comprising a hook looper. In order to switch its operation from an ordinary over-edge chain stitch to a rolled seam, a presser foot and a needle plate are replaced with those for the rolled seam, while the tension of a lower looper thread or a looper thread (hereinafter referred to as a bobbin thread) is increased and the feed rate is reduced. FIG. 1 shows an ordinary over-edge chain stitch which is formed by a conventional overlock sewing machine with one needle and three threads, and FIG. 2 shows a conventional rolled seam which is formed by increasing bobbin thread tension (to about twice that in an ordinary over-edge chain stitch) and reducing the feed rate for retracting an upper looper thread to the back side of cloth while reducing the seam pitch. Referring to FIGS. 1 and 2, an ordinary over-edge chain stitch portion and a rolled seam portion each comprise a needle thread 101, an upper looper thread 102 and a lower looper thread 103. Such a rolled seam is generally employed for an over-edge chain stitch for a handkerchief or the like since the cloth edge is rolled and beautified on the upper part.

In most of general overlock sewing machines, parts such as a presser foot and a needle plate are replaced with those which are dedicated for a rolled seam while the tension of a bobbin thread must be strengthened in the case of forming the rolled seam, as hereinabove described. In this case, an adjustment operation for attaining preferable tension balance is not easy due to a seam by complicated intertwinement of a plurality of threads, and a considerable time is required for the adjustment of the tension as the result. This also applies to the case of returning the operation from the rolled seam to an ordinary over-edge chain stitch, and the presser foot and the needle plate are changed to ordinary standard parts while a complicated adjustment operation is required for attaining preferable tension balance which is suitable for the over-edge chain stitch.

SUMMARY OF THE INVENTION

An object of the present invention is to provide an overlock sewing machine which can readily switch its operation from an over-edge chain stitch to a rolled seam or vice versa without carrying out a complicated tension adjustment operation.

Another object of the present invention is to provide an overlock sewing machine which can adjust tension as well as a feed rate through a serial operation.

An overlock sewing machine according to an aspect of the present invention comprises a spring and a switching mechanism. The spring is adapted to provide a thread with prescribed tension. The switching mechanism is adapted to switch thread tension between that for a rolled seam and that for an over-edge chain stitch by switching the spring between a tensioning state and a non-tensioning state. The thread tension can be readily switched between that for the rolled seam and that for the over-edge chain stitch due to the provision of the switching mechanism for switching the spring between the tensioning state and the non-tensioning state. The overlock sewing machine may further include a feed adjusting mechanism for adjusting the feed rate of the thread so that the switching mechanism interlocks with the feed adjusting mechanism. In this case, the thread tension and the feed rate can be adjusted through a single operation, whereby the switching operation can be further readily performed. The aforementioned switching mechanism preferably includes a cam for switching the spring between the tensioning state and the non-tensioning state.

An overlock sewing machine according to another aspect of the present invention comprises a thread tension shaft, a pair of thread tension discs, a main spring, an auxiliary spring, and a release mechanism. The thread tension shaft is supported by a sewing machine frame, and the thread tension discs are fitted with the thread tension shaft to face each other. The main spring presses the pair of thread tension discs against each other, and provides a looper thread passing through between the thread tension discs with thread tension which is necessary for forming an ordinary over-edge chain stitch. The auxiliary spring provides the looper thread passing through between the thread tension discs with thread tension which is necessary for forming a rolled seam in association with the main spring. The release mechanism is adapted to release the auxiliary spring from the action on the thread tension discs. Due to this structure, both of the main spring and the auxiliary spring provide the looper thread with thread tension for forming a rolled seam, while the auxiliary spring is released from the action on the thread tension discs by the release mechanism so that only the main spring acts on the thread tension discs for forming an over-edge chain stitch. Consequently, it is not necessary to adjust the thread tension for changing the operation from an ordinary over-edge chain stitch to a rolled seam or vice versa, whereby tension balance once obtained may not be changed. Thus, the operation can be readily switched from the over-edge chain stitch to the rolled seam or vice versa, while this switching can be made by a single thread tensioner, whereby the mechanism of the thread tensioner can be simplified. Further, the thread path may not be changed for switching the operation between the over-edge chain stitch and the rolled seam. In the structure of this aspect, the overlock sewing machine may further include a feed adjusting mechanism for adjusting the feed rate of the thread so that the release mechanism interlocks with the feed adjusting mechanism. In this case, the switching of the tension between that for the over-edge chain stitch and that for the rolled seam and the adjustment of the feed rate can be made through a single operation, whereby the switching can be readily performed since the switching of the tension and the adjustment of the feed rate may not be performed independently of each other. Further, the release mechanism may include a spring presser for applying the action of the auxiliary spring to the thread tension discs, a switching cam which is fixed to the shaft of a dial for feed rate adjustment, and a lever which is engaged with the switching cam for forcing the spring presser against the action of the auxiliary spring for inhibiting the auxiliary spring from acting on the thread tension discs. In this case, it is possible to change the feed rate while releasing or returning the auxiliary spring from or to the action on the thread tension discs by operating the dial for feed rate adjustment. The aforementioned switching cam is preferably provided with a high portion for the over-edge chain stitch and a low portion for the rolled seam, so that the feed rate can be adjusted in the high and low portions respectively. In this case, the feed rate can be adjusted when the operation is switched from the over-edge chain stitch to the rolled seam or vice versa. The overlock sewing machine preferably further includes a tension adjusting knob for adjusting the thread tension, which is provided to project from the front surface of a sewing machine cover. Thus, a control operation is easy to perform. In this case, the tension adjusting knob is preferably fixed to the thread tension shaft so that the tension provided by the main spring is adjusted by rotating the tension adjusting knob.

An overlock sewing machine according to still another aspect of the present invention comprises a switching mechanism having a cam for switching thread tension between that for a rolled seam and that for an over-edge chain stitch. Due to such employment of the cam, the thread tension can be readily switched. In the structure according to this aspect, the overlock sewing machine preferably further includes a feed adjusting mechanism for adjusting the feed rate of the thread, so that the cam of the switching mechanism interlocks with the feed adjusting mechanism. Thus, the switching between that for the over-edge chain stitch and that for the rolled seam and the adjustment of the feed rate can be made through a single operation, whereby the switching operation can be further readily performed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
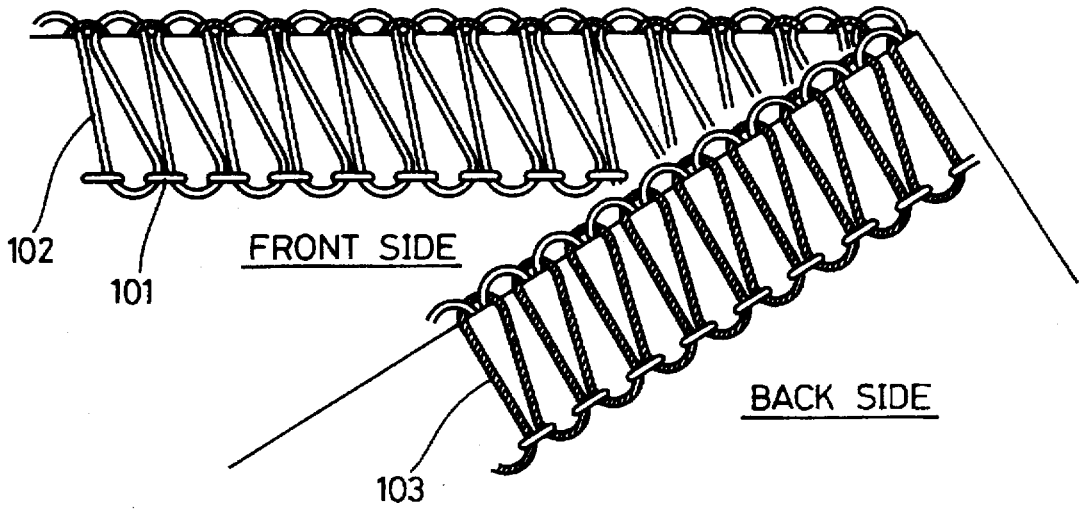
FIG. 1 PRIOR ART
FIG. 1 is a perspective view showing a conventional ordinary over-edge chain stitch with one needle and three threads.
Figure 2:
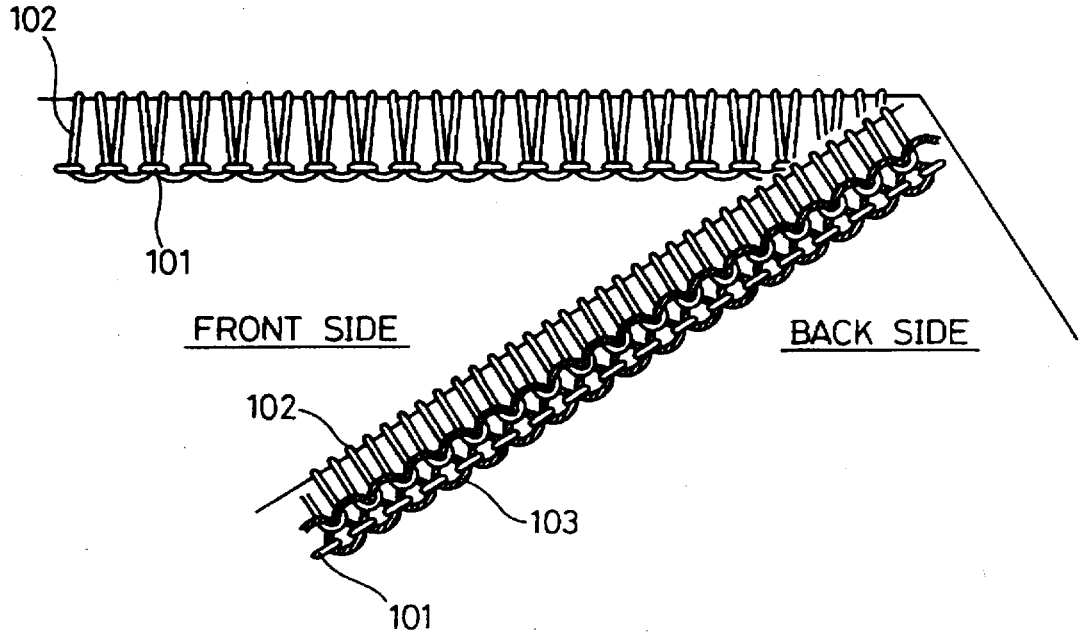
FIG. 2 PRIOR ART
FIG. 2 is a perspective view showing a conventional rolled seam with one needle and three threads.
Figure 3:
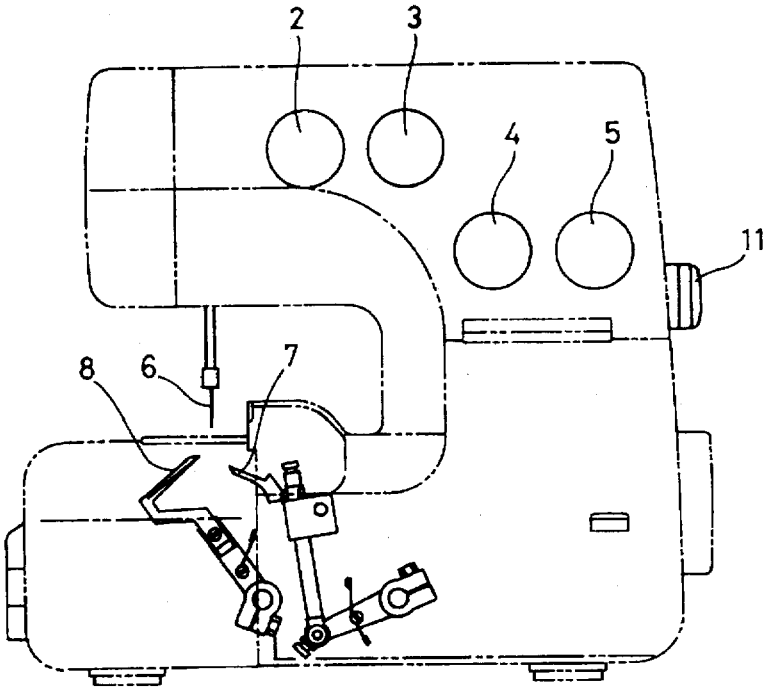
FIG. 3 is a front elevational view showing an overlock sewing machine with two needles and three threads according to the present invention.
Figure 4:
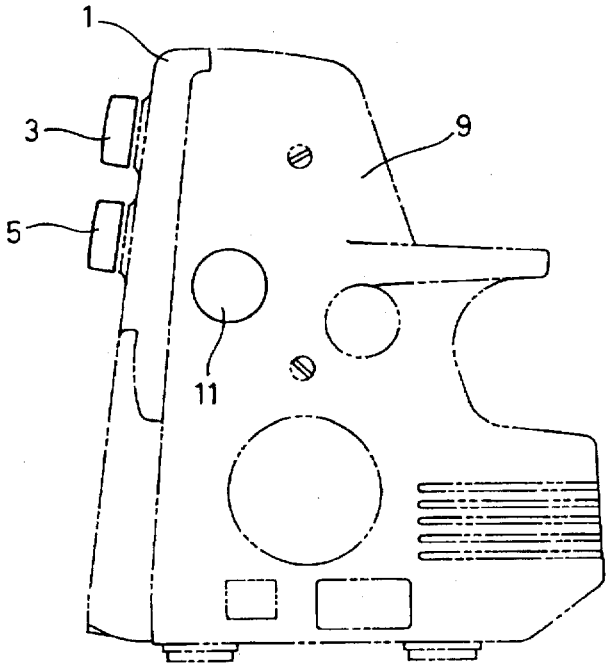
FIG. 4 is a side elevational view of the overlock sewing machine shown in FIG. 3.
Figure 5:
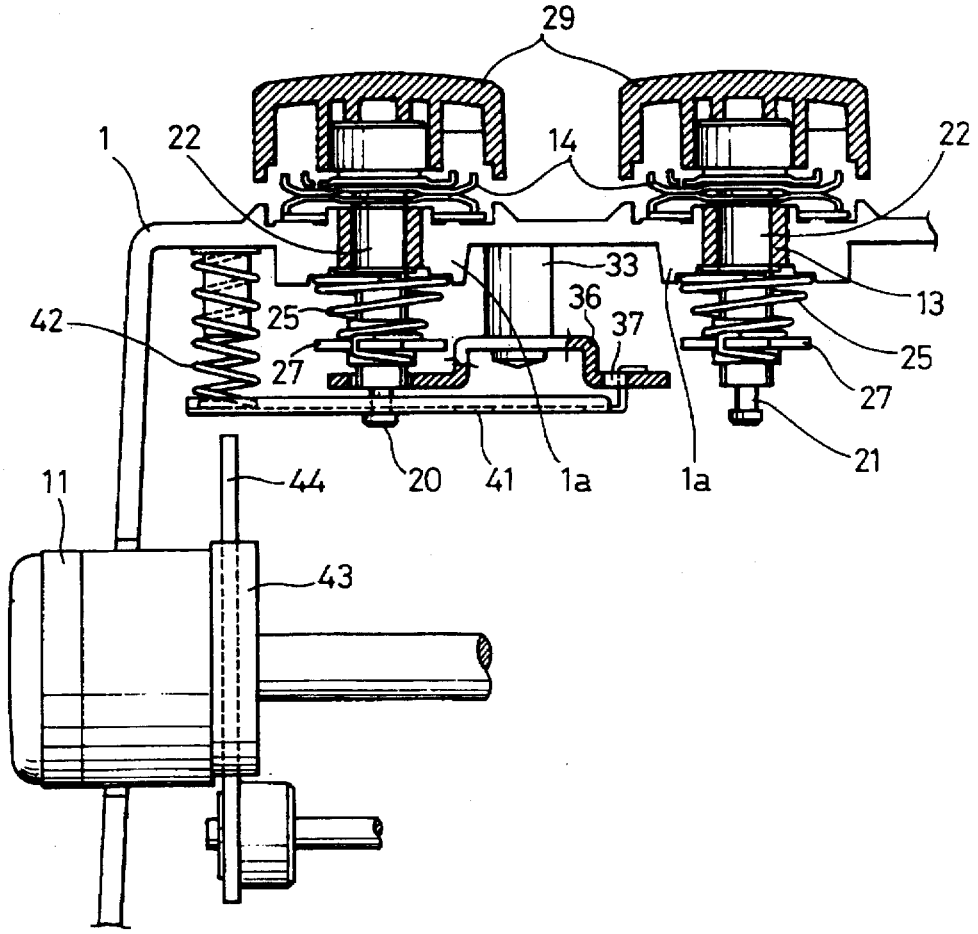
FIG. 5 is a sectional view showing a principal part of the overlock sewing machine shown in FIGS. 3 and 4.
Figure 6:
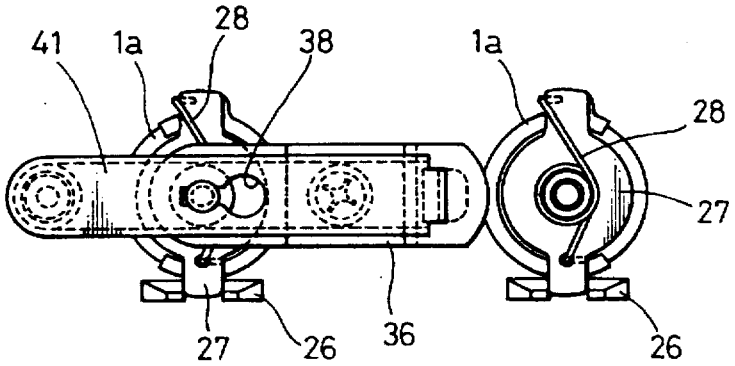
FIG. 6 is a side elevational view of thread tensioners shown in FIG. 5.
Figure 7:
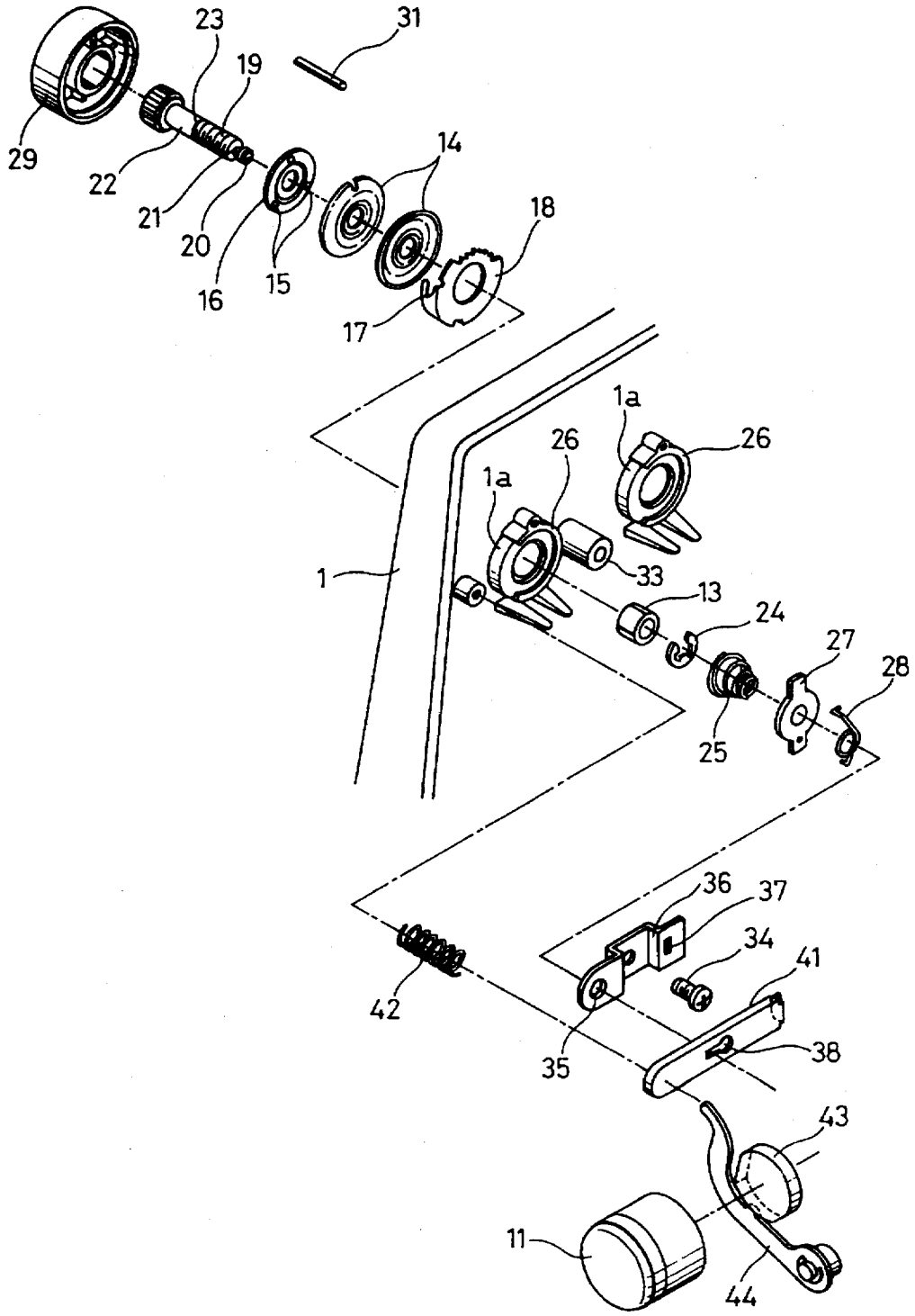
FIG. 7 is an exploded perspective view of the thread tensioners shown in FIG. 5.

An embodiment of the present invention is now described with reference to the drawings. Referring to FIGS. 3 and 4, a left needle thread tensioner 2, a right needle thread tensioner 3, an upper looper thread tensioner 4, and a lower looper thread tensioner 5, which are employed for using the overlock sewing machine as that with two needles and three threads, are arranged on a front surface upper part of a sewing machine cover 1. A needle thread, an upper looper thread and a lower looper thread which are delivered from spools (not shown) to the thread tensioner 3, the thread tensioner 4 and the thread tensioner 5 pass through a needle 6, an upper looper 7 and a lower looper 8 along prescribed thread paths respectively. A dial 11 for feed adjustment is provided to project from a side surface of a sewing machine body 9. The feed rate is adjusted by a rotational operation of this dial 11.

Each of the aforementioned thread tensioners 2, 3, 4 and 5 comprises a bush 13, a pair of thread tension discs 14, a tension disc presser 16, a washer 18, a thread tension shaft 22, an E-ring 24, a coil spring 25, a coil spring presser 27, a helical spring 28, a tension adjusting knob 29, and a stopper pin 31. The bush 13 is forcibly engaged with a thick support portion 1*a* which is integrally formed on the sewing machine cover 1. The pair of thread tension discs 14 are oppositely fitted with each other. The tension disc presser 16 is circumferentially provided with three projections 15 at regular intervals on a side facing the thread tension discs 14. The washer 18 is integrally formed with a thread guard 17. The thread tension shaft 22, which is slidably and rotatably fitted in the bush 13 through the tension disc presser 16, the pair of tension discs 14 and the washer 18, has a screw 19 provided on its forward end and a small diameter portion 21 provided between the screw 19 and a head portion 20. The E-ring 24 is fitted in a groove 23 of the thread tension shaft 22 projecting from the bush 23. The coil spring presser 27 is mounted on the screw 19 in a screwed manner, and fitted in a fork fitting 26 which is mounted on the support part 1*a*. The helical spring 28 urges the coil spring presser 27 in a single rotational direction and presses this coil spring presser 27 against a side portion of the fork of the fork fitting 26. The tension adjusting knob 29 is fitted in and fixed to an end of the thread tension shaft 22 projecting from the front surface of the sewing machine cover 1. The stopper pin 31 is fitted in the front surface of the sewing machine cover 1, for detention of the pair of thread tension discs 14.

When the thread tension shaft 22 is rotated by the tension thread knob 29 in one direction or an opposite direction, the coil spring presser 27 advances or retreats along the screw 19 of the thread tension shaft 22. Thus, the coil spring 25 which is positioned between the support portion 1*a* and the coil spring presser 27 contracts or expands to change the spring pressure. Consequently, the pressure between the thread tension discs 14 is adjusted.

Among the thread tensioners 2, 3, 4 and 5, the lower looper thread tensioner 5 further comprises a convex fitting 36, a long plate-shaped spring presser 41, and a coil spring 42. The convex fitting 36 is fixed to a mounting eye 33 which is formed to project from the surface of the sewing machine cover 1 by a set screw 34, so that a hole 35 provided in one end of the fitting 36 is engaged with the screw 19 of the thread tension shaft 22 with allowance. The long plate-shaped spring presser 41 is inserted in an insertion hole 37 provided in another end of the fitting 36, and supported in an inclinable manner. The head portion 20 of the thread tension shaft 22 is inserted in a circular portion of a keyhole 38 which is formed in the center of the spring presser 41, and thereafter longitudinally displaced so that the small diameter portion 21 is fitted in a slit portion of the keyhole 38. The coil spring 42 is interposed between the surface of the sewing machine cover 1 and the spring presser 41. Due to this structure, the coil spring 42 presses the head portion 20 of the thread tension shaft 22 whose small diameter portion 21 is fitted in the slit portion through the spring presser 41. The coil spring 42 serves as an auxiliary spring for applying auxiliary tension between the thread tension discs 14. Namely, both of the coil springs 25 and 42 act between the pair of thread tension discs 14 for forming a rolled seam.

Figure 8:
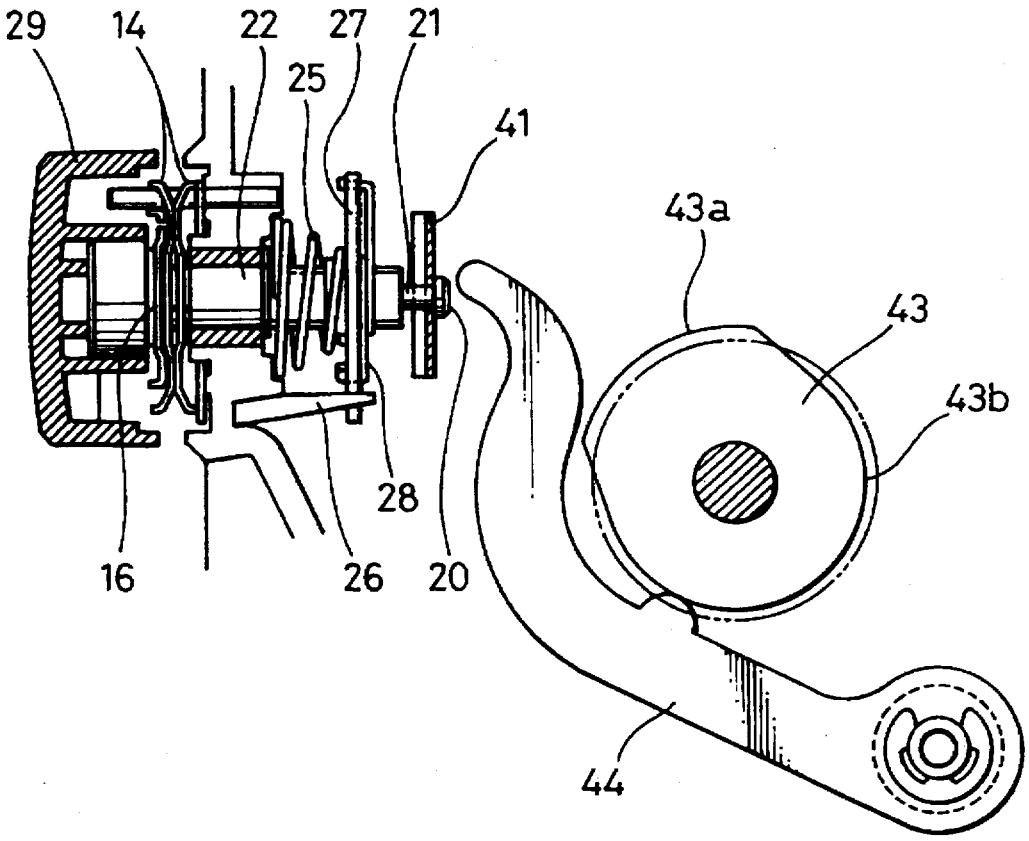
FIG. 8 is a sectional view of the inventive overlock sewing machine forming a rolled seam.
Figure 9:
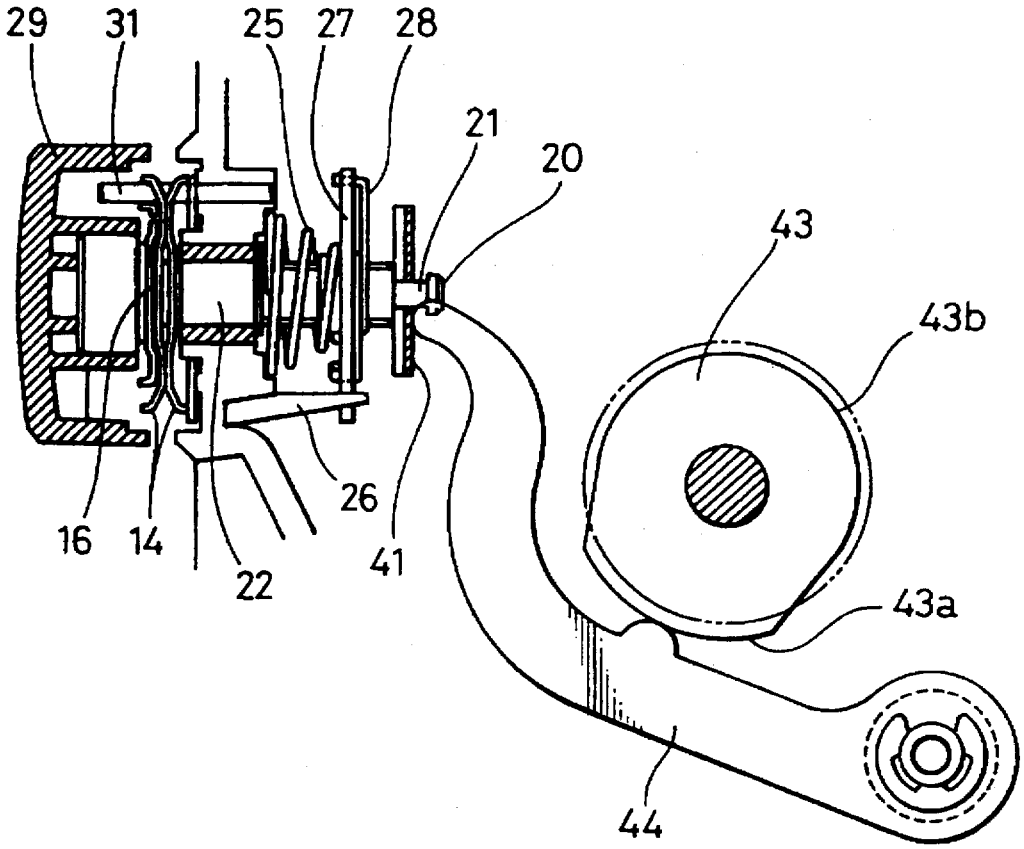
FIG. 9 is a sectional view of the inventive overlock sewing machine forming an over-edge cross stitch.

A switching cam 43 is integrally coupled to the dial 11 for feed rate adjustment, and integrally rotated with the dial 11. As shown in FIGS. 8 and 9, a lever 44 is engaged with the switching cam 43. Thus, the switching cam 43 is rotated upon rotation of the dial 11, whereby the lever 44 is rotated anticlockwise from the state shown in FIG. 8. Thus, the lever 44 forces the spring presser 41 against the action of the coil spring 42, thereby separating the same from the head portion 20 (see FIG. 9). Consequently, no action of the coil spring 42 is applied to the thread tension shaft 22. In order to form an ordinary over-edge chain stitch in the overlock sewing machine according to this embodiment having the aforementioned structure, the switching cam 43 is switched to the position shown in FIG. 9 by the dial 11 for forcing the spring presser 41 with the forward end of the lever 44 thereby releasing the coil spring 42 from the action on the thread tension discs 14. Thus, only the coil spring 25 acts on the thread tension discs 14.

In the case of the over-edge chain stitch, the feed rate is adjusted while a high portion 43*a* of the switching cam 43 acts on the lever 44. In the case of the rolled seam, on the other hand, the feed rate is adjusted while a lower portion 43*b* of the switching cam 43 acts on the lever 44. While the lower portion 43*b* of the switching cam 43 acts on the lever 44, the feed rate is reduced as compared with that for the over-edge chain stitch.

According to the overlock sewing machine of this embodiment, the thread tension may not be adjusted for switching the operation from the ordinary over-edge chain stitch to the rolled seam or vice versa, and hence tension balance once attained may not be changed. Thus, the operation can be extremely readily switched from the over-edge chain stitch to the rolled seam or vice versa. Further, the operation is switched between the over-edge chain stitch and the rolled seam by a single thread tensioner, whereby the mechanism is simplified and the thread path may not be changed in such switching between the over-edge chain stitch and the rolled seam. Further, the switching of the tension between that for the over-edge chain stitch and that for the rolled seam and the adjustment of the feed rate can be made through a single dial operation. Further, the overlock sewing machine is easy to handle since the tension adjusting knob 29 projects from the front surface of its frame.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An overlock sewing machine comprising:

a sewing machine frame;

a thread tension shaft being supported by said sewing machine frame;

a pair of thread tension discs being fitted with said thread tension shaft to face each other;

a main spring pressing said pair of thread tension discs against each other and providing a looper thread passing through between said thread tension discs with thread tension being necessary for forming an ordinary over-edge chain stitch;

an auxiliary spring providing said looper thread passing through between said thread tension discs with thread tension being necessary for forming a rolled seam in association with the main spring, said main spring and said auxiliary spring each applying pressure to the pair of thread tension discs; and a release mechanism for releasing said auxiliary spring from action on said thread tension discs.

2. The overlock sewing machine in accordance with claim 1, further including a feed adjusting mechanism adjusting the feed rate of said fabric, said release mechanism being provided to interlock with said feed adjusting mechanism.

3. The overlock sewing machine in accordance with claim 2, wherein said feed adjusting mechanism includes a dial for feed rate adjustment, said release mechanism including:

a spring presser for applying said action of said auxiliary spring to said thread tension discs, a switching cam being fixed to a shaft of said dial for feed rate adjustment, and a lever being engaged with said switching cam for forcing said spring presser against said action of said auxiliary spring for inhibiting said auxiliary spring from acting on said thread tension discs.

4. The overlock sewing machine in accordance with claim 3, wherein said switching cam has a high portion for an over-edge chain stitch and a lower portion for a rolled seam, said high and low portions being capable of adjusting the feed rate respectively.

5. The overlock sewing machine in accordance with claim 2, further including a tension adjusting knob for adjusting tension of said thread, said tension adjusting knob being provided to project from the front surface of a sewing machine cover.

6. The overlock sewing machine in accordance with claim 5, wherein said tension adjusting knob is fixed to said thread tension shaft, so that said tension being provided by said main spring is adjusted by rotating said tension adjusting knob.

* * * * *